US012661702B2

(12) United States Patent
Gnutti et al.

(10) Patent No.: US 12,661,702 B2
(45) Date of Patent: Jun. 23, 2026

(54) APPARATUS FOR MECHANICAL BEADING MACHINING AND CORRESPONDING TRANSFER MACHINE COMPRISING SAID APPARATUS

(71) Applicant: Gnutti Transfer S.p.A., Ospitaletto (IT)

(72) Inventors: Renato Gnutti, Ospitaletto (IT); Stefano Coraglia, Ospitaletto (IT)

(73) Assignee: GNUTTI TRANSFER S.P.A., Ospitaletto (IT)

( * ) Notice: Subject to any disclaimer, the term of this patent is extended or adjusted under 35 U.S.C. 154(b) by 379 days.

(21) Appl. No.: 18/228,036

(22) Filed: Jul. 31, 2023

(65) Prior Publication Data

US 2024/0042506 A1 Feb. 8, 2024

(30) Foreign Application Priority Data

Aug. 4, 2022 (IT) ..... 102022000016734

(51) Int. Cl.
*B21D 17/04* (2006.01)
*B21D 19/02* (2006.01)

(52) U.S. Cl.
CPC ..... *B21D 17/04* (2013.01); *B21D 19/02* (2013.01)

(58) Field of Classification Search
CPC ..... B21D 15/06; B21D 17/04; B21D 19/02; B21D 19/04; B21D 19/046
See application file for complete search history.

(56) References Cited

U.S. PATENT DOCUMENTS 2,924,263 A * 2/1960 Landis ..... B21D 41/02 72/117
3,122,830 A 3/1964 Dawson et al.
4,091,648 A 5/1978 McCaslin
(Continued)

FOREIGN PATENT DOCUMENTS

EP 0140469 5/1985

OTHER PUBLICATIONS

JP 61-186135A, Moro et al. Aug. 1986.*
Search report dated Mar. 21, 2023; Application No. IT 102022000016734; 10 pages.

*Primary Examiner* — Edward T Tolan
(74) *Attorney, Agent, or Firm* — Rankin Hill & Clark, LLP; Erik J. Overberger

(57) ABSTRACT

The present invention relates to an apparatus for mechanical beading machining, comprising:
- a support unit configured to support a workpiece;
- a processing unit facing the support unit, comprising:
  - a tool configured to perform a mechanical beading machining on the workpiece;
  - a spindle configured to support and rotate the tool about a machining axis;
  - actuation members associated to the spindle and adapted to actuate the rotation of the tool about the machining axis;

wherein the spindle comprises:
- a first body configured to be driven in rotation by the actuation members about the machining axis;
- a second body mounted on the first body eccentrically with respect to the machining axis, in detail the second body is rotatably connected to the first body about an adjustment axis and the tool is mounted on the second body eccentrically with respect to the adjustment axis.

10 Claims, 11 Drawing Sheets

(56) References Cited

U.S. PATENT DOCUMENTS

| | | | | | |
|---|---|---|---|---|---|
| 4,272,977 | A | | 6/1981 | Gombas | |
| 4,462,235 | A | * | 7/1984 | King | B21D 17/04 72/115 |
| 4,619,130 | A | * | 10/1986 | Buzzi | B43K 1/08 72/126 |
| 5,076,087 | A | | 12/1991 | Slater | |
| 5,706,686 | A | * | 1/1998 | Babbitt | B21D 51/26 72/123 |
| 6,058,753 | A | * | 5/2000 | Jowitt | B21D 51/26 72/94 |
| 2001/0022100 | A1 | * | 9/2001 | Nogami | B21D 22/14 72/121 |

* cited by examiner

APPARATUS FOR MECHANICAL BEADING MACHINING AND CORRESPONDING TRANSFER MACHINE COMPRISING SAID APPARATUS

TECHNICAL FIELD

The present invention relates to an apparatus for mechanical beading machining and a machine tool, a transfer machine, comprising such an apparatus.

The present invention finds useful application in the field of mechanical beading machining of pipes, for example, for the manufacture of ducts with circumferential bulges and press fitting elements.

STATE OF THE ART

Machine tools for forming ducts with variable sections are known in the state of the art.

For example, EP1294501B1 discloses a machine tool for making fitting elements with annular bulges adapted to receive sealing elements such as an O-ring.

In detail, such a machine tool comprises a punch configured to exert a thrust on an end of a pipe to be machined and plastically deform it against a mould to achieve said annular bulge.

The machine tool that is the object of EP1294501B1 further comprises a rolling element configured to define the inner geometry of the annular bulge.

Specifically, the rolling element comprises a rod-shaped body having, at one end thereof, a roller configured to be pressed against the inner surface of the annular bulge so as to plastically deform it and define its inner geometry.

In detail, in use, the roller is introduced into the pipe to be machined and pressed radially outwards while special movement members, acting on the rod-shaped body, place it repeatedly in rotation about a machining axis so as to retract the entire inner surface of the annular bulge several times.

It should be noted that the rolling elements of the known machine tools exert high thrusts on the inner surface of the annular bulge especially in the first passes of the roller. Consequently, the plastic deformation of the inner surface of the annular bulge is mostly achieved in the first pass of the roller.

To avoid the formation of undulations on the inner surface of the annular bulge due to the sudden application and removal of the radial thrust, the speed of movement of the roller about the machining axis must be contained, in particular in the first passes in which the majority of the plastic deformation occurs.

It is evident that such a limitation on the roller movement speed significantly increases the machining times of the inner surface of the annular bulge, thereby reducing the production capacity of the machine tool.

The high cycle times required for processing the inner surface of the annular bulge render incompatible the integration of the aforementioned technologies in transfer machines. In this regard, it should be noted that high processing times clash with the need for transfer machines to reduce the cycle time as much as possible.

SUMMARY OF THE INVENTION

In this context, the technical task of the present invention is to propose an apparatus for mechanical beading machining and a corresponding transfer machine that overcomes the drawbacks of the known art mentioned above.

In particular, it is an object of the present invention to provide an apparatus for mechanical beading machining able to reduce the machining times without compromising the quality.

In addition, it is an object of the present invention to provide an apparatus for mechanical beading machining that can be integrated into a machine tool with automatic piece transfer.

The specified technical task and the specified purposes are substantially achieved by a mechanical beading machining apparatus and a corresponding transfer machine comprising the technical characteristics set forth in one or more of the attached claims.

Advantages of the Invention

The apparatus according to the present invention solves the technical problem in that it comprises a spindle having a first body configured to be rotated about a machining axis, and a second body, eccentrically mounted on the first body with respect to the axis of rotation and connected to the first body rotatably about an adjustment axis, on which the tool is eccentrically mounted with respect to the adjustment axis.

It should be noted that by varying the angular position of the second body with respect to the first about the adjustment axis it is possible to modify the distance of the tool with respect to the machining axis.

Therefore, in use, by gradually varying the angular position of the second body with respect to the first about the adjustment axis, it is possible to evenly distribute the deformation action of the tool on the workpiece in its different passes. This effect can be obtained, for example, by continuously varying the angular position of the second body with respect to the first while the latter rotates about the machining axis. In fact, by doing so, the tool will perform a spiral motion about the machining axis exerting an almost constant thrust on the workpiece on each turn.

Thus, on each pass, a gradual deformation of the workpiece will be obtained that allows the speed of movement of the tool about the machining axis to be increased without incurring the risk of forming undulations on the machined surface. In fact, the plastic deformation is not concentrated mostly in the first pass of the tool but evenly distributed in its different passes.

Therefore, advantageously, the apparatus that is the object of the present invention allows the processing times for the execution of beading machining to be reduced, thus making it suitable for integration in the machining stations of transfer machines.

LIST OF FIGURES

Further features and advantages of the present invention will become clearer from the indicative, and therefore non-limiting, disclosure of an apparatus for mechanical beading machining and corresponding transfer machine, as illustrated in the accompanying drawings, wherein.

FIGS. 10*a*, 10*b*, 10*c*, 11*a*, 11*b* schematically show the kinematics of the apparatus for mechanical beading machining as the relative angular position of some of its components varies.

DETAILED DESCRIPTION

With reference to the attached figures, the present invention relates to an apparatus 1 for mechanical beading machining, in particular of axisymmetric pieces such as, for example, pipes or cylindrical portions of fitting elements.

In the context of the present invention "mechanical beading machining" means all those processes of machining for plastic deformation of axisymmetric pieces (or axisymmetric portions of workpieces) configured to generate radial plastic deformations with respect to the axis of the piece.

For example, mechanical beading machining is to be considered as mechanical machining adapted to locally modify the section of cylindrical components, such as pipes, ducts and fittings, to realize annular bulges such as housing seats for gaskets, widenings or tapers.

In particular, those mechanical machining processes for plastic deformation that define the inner geometry of cylindrical components are to be considered as mechanical beading machining.

In English, mechanical beading machining processes are commonly referred to as "beading", and the machines that make them as "beading machines".

Figure 2:
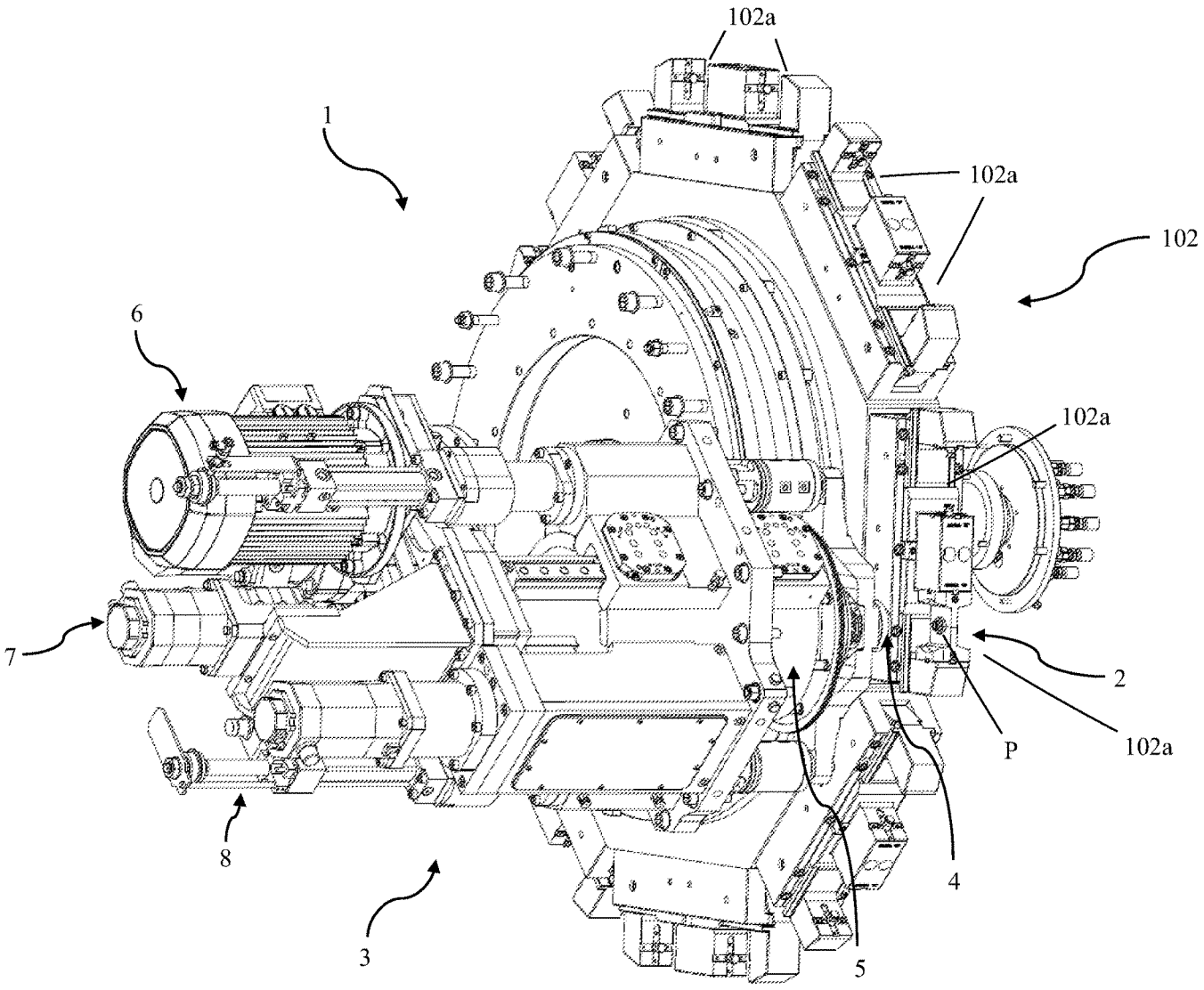
FIG. 2 shows a perspective view of the transfer machine of FIG. 1 with some components removed to better illustrate said apparatus.

With reference to FIG. 2, the apparatus 1 comprises a support unit 2 configured to support a workpiece P and a processing unit 3, facing the support unit 2, configured to carry out a mechanical beading machining on the workpiece P.

Figure 7:
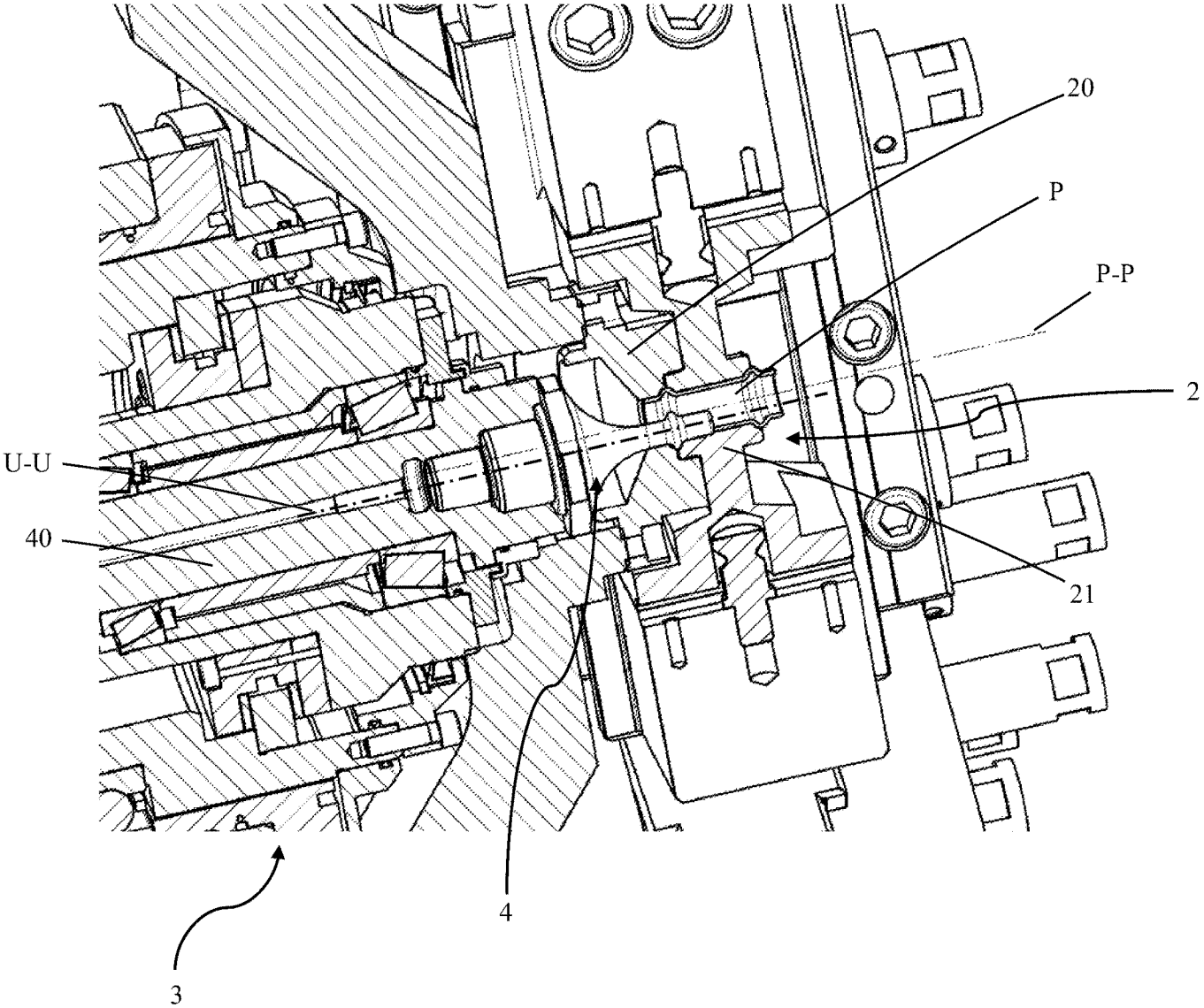
FIG. 7 shows a magnification of FIG. 6.

Specifically, with reference to FIG. 7, the support unit 1 has gripping members 21, such as self-centring clamps, adapted to grip the workpiece P and orient it in such a way that the processing unit 3 can carry out the mechanical beading machining.

It should be specified that in the context of the present invention the workpiece P has an axisymmetric geometry or an axisymmetric portion, i.e. it has a radial symmetry with respect to an axis P-P of the piece P. Preferably, but not necessarily, the workpiece P is a pipe or a fitting element having a cylindrical portion.

Figure 3:
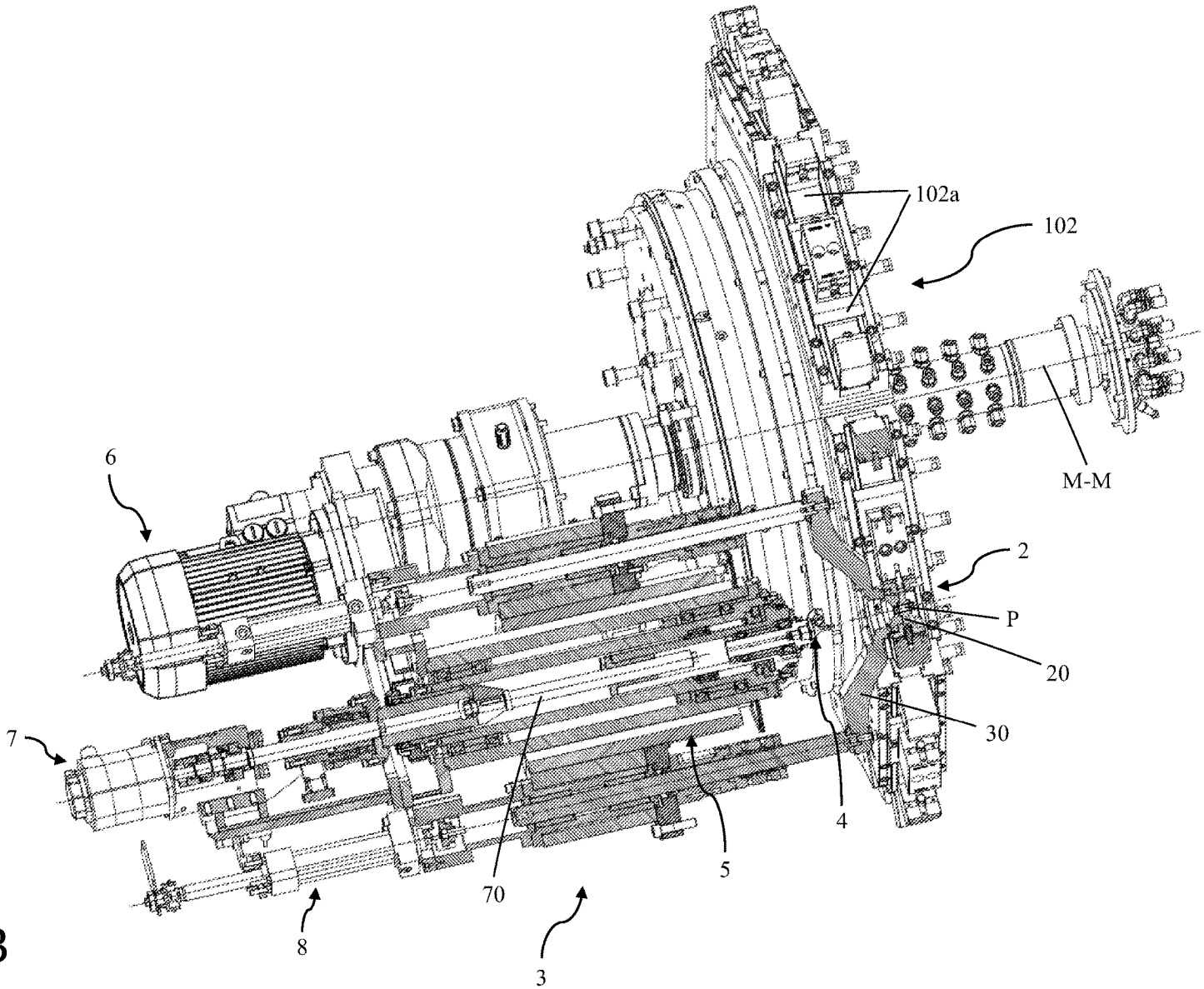
FIG. 3 shows a perspective view of the transfer machine of FIG. 1 with some components removed and the apparatus in section, in detail the apparatus is represented in a rest position.
Figure 4:
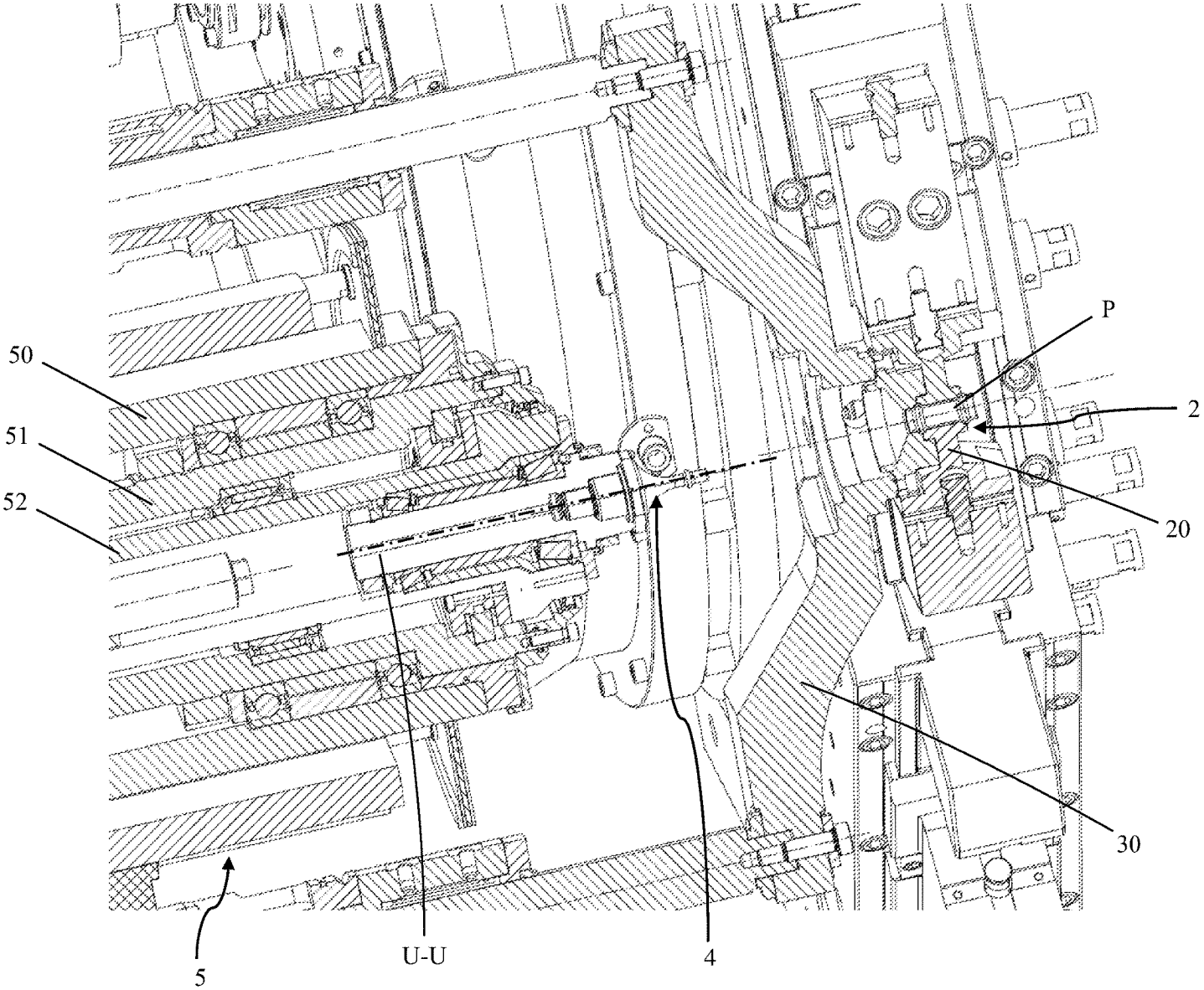
FIG. 4 shows a magnification of FIG. 3 to better highlight some technical details.

The support unit 2 is configured to arrange the workpiece P with the axis of the piece P-P facing the processing unit 3, according to what is shown in FIG. 3. Specifically, the support unit 2 is configured to arrange the workpiece P with the axis of the piece P-P coinciding with what will hereinafter be defined as the machining axis A-A.

Figure 5:
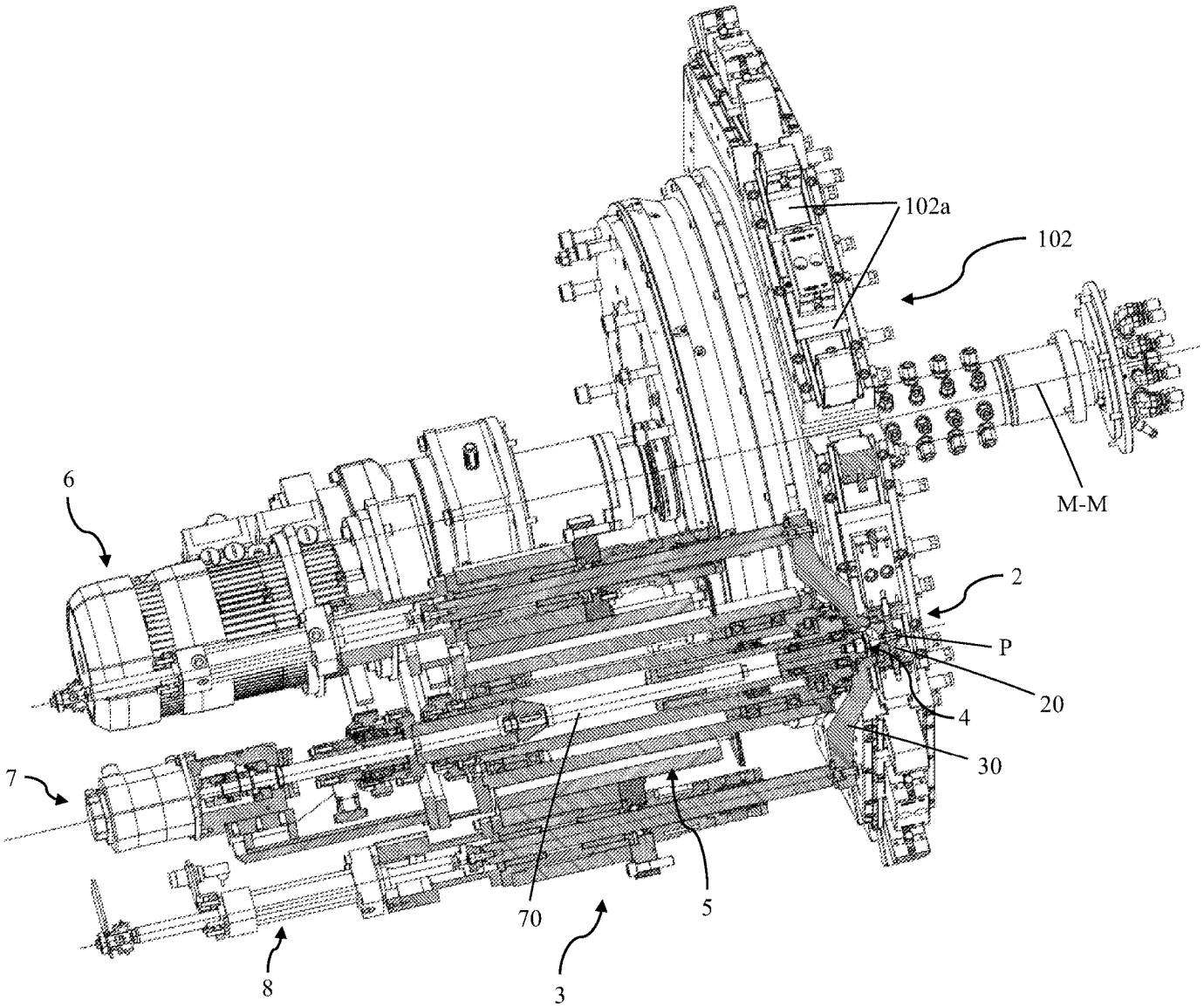
FIG. 5 shows a perspective view of the transfer machine of FIG. 1 with some components removed and the apparatus in section, in detail the apparatus is represented in an operating position.

With reference to FIGS. 3 and 5, the processing unit 3 comprises a tool 4 configured to plastically deform the workpiece P and perform a mechanical beading machining.

In detail, during machining, the tool 4 comes into contact with the workpiece P and exerts a thrust on it in a radial direction with respect to the axis of the piece P-P so as to plastically deform it and perform said beading machining.

Preferably, the workpiece P is hollow and the tool 4 is inserted into the workpiece P to machine it internally, for example to make an O-ring housing seat.

The tool 4 can also be used to rework a previously made annular groove to better define its geometry.

It should be specified that the tool 4 can be employed for machining both end portions and intermediate portions of the workpiece P.

The processing unit 3 further comprises a spindle 5 configured to support the tool 4 and rotate it about a machining axis A-A.

With reference to FIG. 7, the tool 4 extends along a tool axis U-U projecting from the spindle 5. Preferably, the tool 4 is axisymmetric and the tool axis U-U coincides with its radial axis of symmetry.

In detail, with reference to FIGS. 10*a*, 10*b*, 10*c*, 11*a* and 11*b*, the spindle 5 is configured to move the tool 4 along a circumferential path C centred on the machining axis A-A and of diameter 2·R (radius R).

Specifically, the circumferential path C is to be considered as the path taken by the tool axis U-U when moved by the spindle 5 about the machining axis A-A.

During machining, the tool 4 travelling along the circumferential path C imposed by the spindle 5 is configured to plastically deform the workpiece, preferably in a plurality of passes.

It should be noted that, in accordance with what is shown in FIGS. 10*a*, 10*b*, 11*a* and 11*b*, the spindle 5 is configured to adjust the width of the diameter 2·R of the circumferential path C taken by the tool 4. That is, the spindle 5 is configured to move the tool 4 towards or away from the machining axis A-A. More details regarding the adjustment of the diameter 2·R of the circumferential path C taken by the tool 4 will be provided in a following part of the disclosure.

The processing unit 3 also comprises actuation members 6 operatively associated with the spindle 5 and adapted to rotate the tool 4 about the machining axis A-A. In other words, the actuation members 6 are configured to actuate the rotation of the tool 4 about the machining axis A-A.

Preferably, the actuation members 6 comprise an electric motor.

Figure 8:
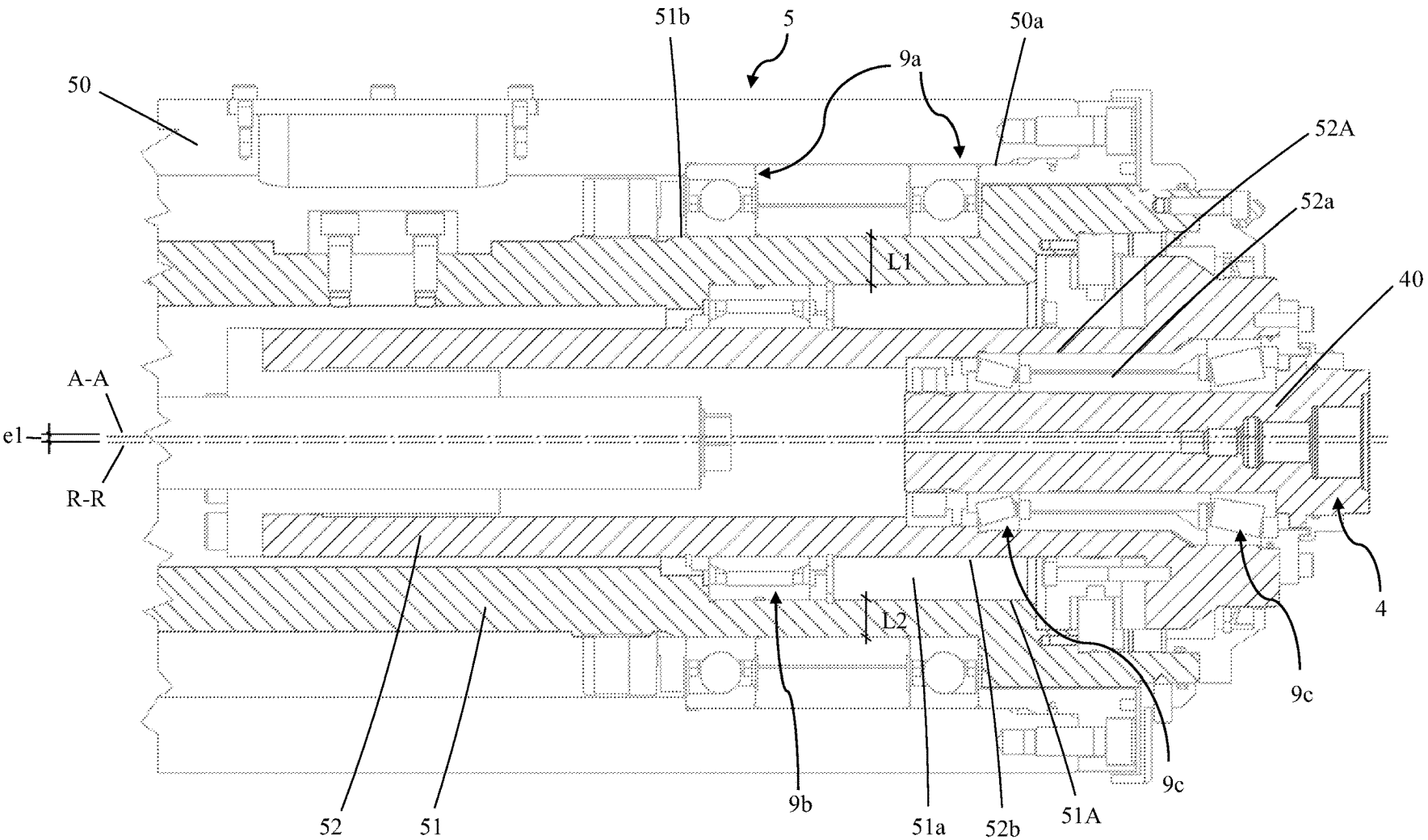
FIG. 8 shows a cross-sectional side view of some components of the apparatus for mechanical beading machining according to the present invention.
Figure 9:
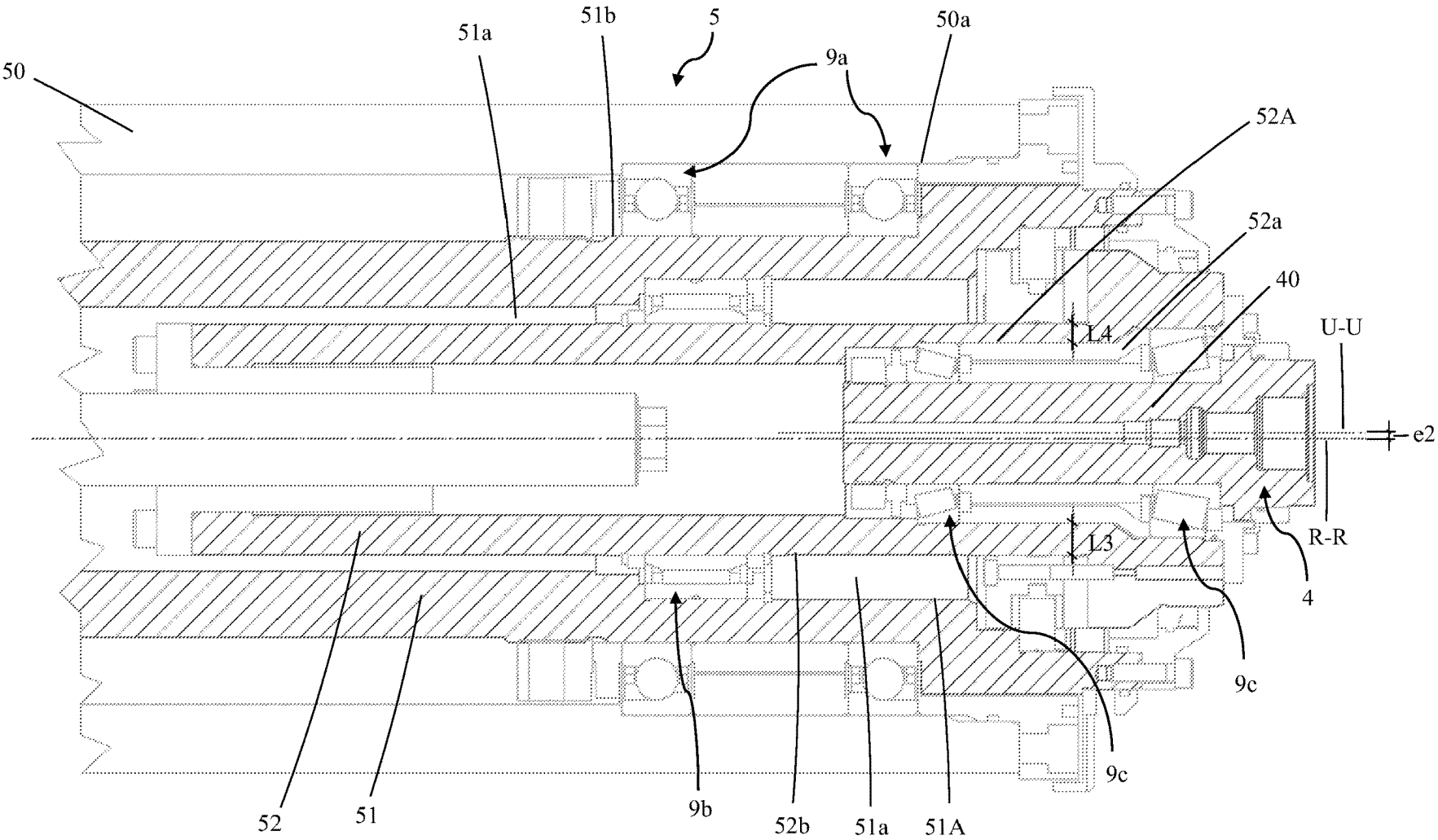
FIG. 9 shows a cross-sectional side view of some components of the apparatus for mechanical beading machining according to the present invention.
Figures 10A, 10B, 10C:
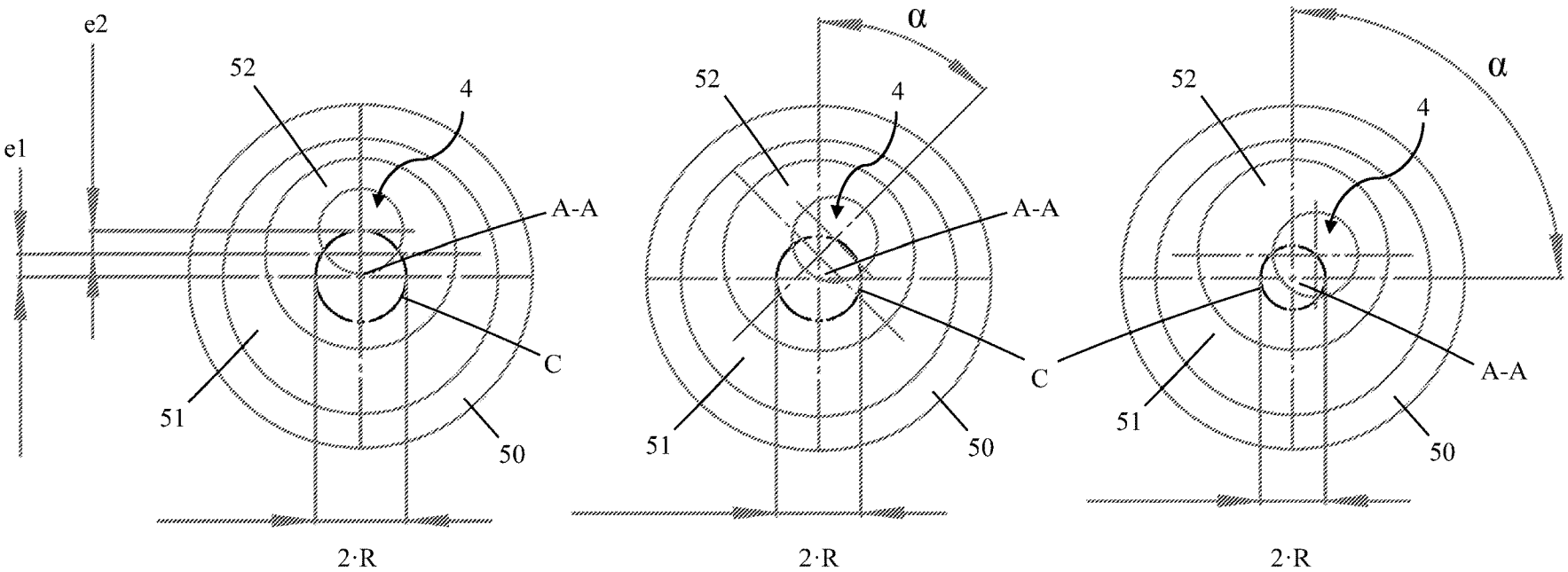

In detail, with reference to FIGS. 8 and 9, the spindle 5 comprises a first body 51 configured to be driven in rotation by the actuation members 6 about the machining axis A-A. The actuation members 6 are then kinematically connected to the first body 51 to set it in rotation about the machining axis A-A.

In the embodiment shown in FIGS. 8 and 9, the spindle 5 comprises a casing 50 inside which the first body 51 is mounted by means of first bearings 9*a*. In detail, the first bearings 9*a* are configured to allow the relative rotation of the first body 51 with respect to the casing 50 about the machining axis A-A.

Preferably, the first bearings 9*a* are interposed between an inner surface of the casing 50*a* and an outer surface 51*b* of the first body 51. It should be noted that both the inner surface 50*a* of the casing 50 and the outer surface 51*b* of the first body 51 have a cylindrical geometry having a radial symmetry with respect to the machining axis A-A. That is, the machining axis A-A is both the axis of the inner surface

50*a* of the casing 50 and the outer surface 51*b* of the first body 51. The inner surface 50*a* of the casing 50 and the outer surface 51*b* of the first body 51 are thus concentric.

Still with reference to FIGS. 8 and 9, the spindle 5 further comprises a second body 52 mounted on the first cover 51 eccentrically with respect to the machining axis A-A.

In other words, the second body 52 is constrained to the first body 51 eccentrically with respect to the machining axis A-A, i.e. with respect to the axis about which the first body 51 is configured to rotate.

It should be noted that, when the first body 51 is rotated by the actuation members 6 about the machining axis A-A, the first body 51 drags the second body 52, in turn rotating it about the machining axis A-A.

Figure 11A:
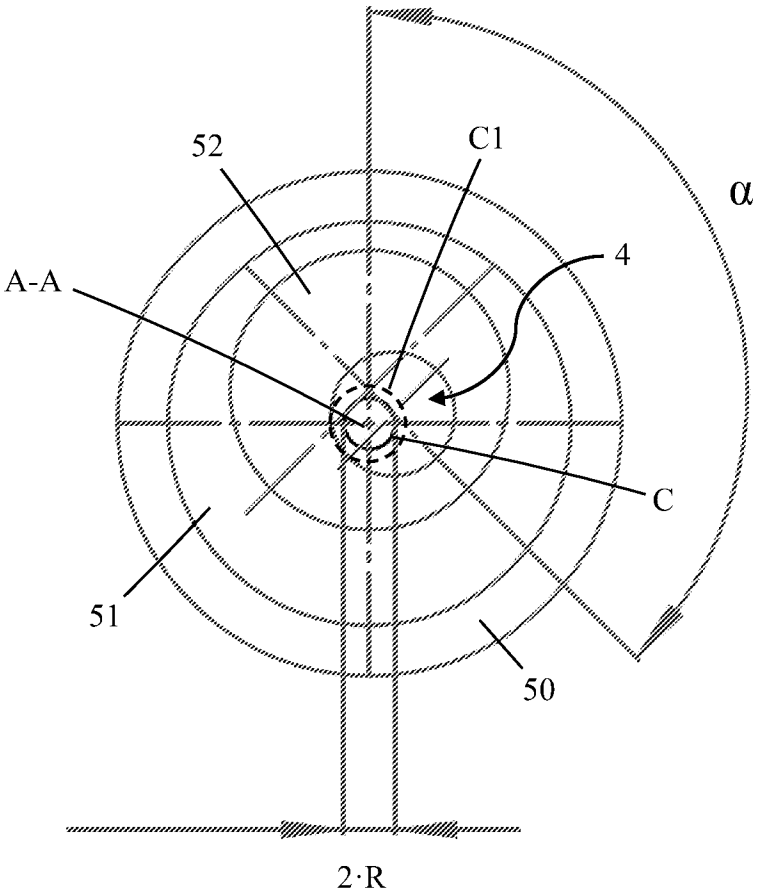
Figure 11B:
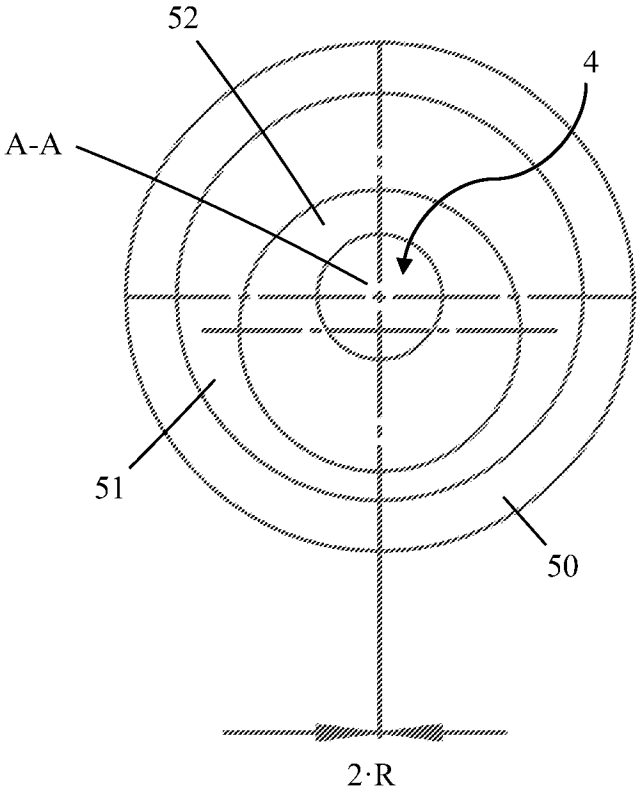

With reference to FIG. 11*a*, the second body 52, when moved by the first body 51, describes a first circumferential path C1 centred on the machining axis A-A. For simplicity of illustration, in the attached figures the first circumferential path is shown only in FIG. 11*a* by means of a dotted circumference marked with C1.

It should be specified that the first circumferential path C1 is the route taken by the axis of the second body 52, identifiable with what is hereinafter referred to as the adjustment axis R-R, when the first body 51 is rotated about the machining axis A-A. The second body 52 is rotatably connected to the first body 51 about an adjustment axis R-R which, as can be seen from FIG. 8, is distinct from the machining axis A-A. As will become clear from the following, the rotation of the second body 52 about the adjustment axis R-R allows the distance of the tool 4 from the machining axis A-A to be changed, i.e. the width of the diameter 2·R of the circumferential path C taken by the tool 4.

Preferably, the machining axis A-A is oriented parallel to the adjustment axis R-R. Specifically, the machining axis A-A is separated from the adjustment axis R-R by a first distance e1 that defines the eccentric of the second body 52 with respect to the first body 51, i.e. the radius R of said first circumferential path C1.

In the embodiment shown in FIGS. 8 and 9, the first body 51 comprises a first cylindrical seat 51*a* having a first axis corresponding to the adjustment axis R-R.

The first cylindrical seat 51*a* is then arranged eccentrically with respect to the outer surface 51*b* of the first body 51. In this regard, it should be noted that the outer surface 51*b* and the eccentric seat 51*a* have distinct axes, respectively the machining axis A-A and the adjustment axis R-R, which are spaced apart by the first distance e1 according to what is shown in FIG. 8.

The eccentricity of the first cylindrical seat 51*a* can be seen in FIG. 8 from the fact that the distance between the outer wall 51*b* and the first cylindrical seat 51*a* has different values when calculated at opposite portions of the first body 51. In this regard, it should be noted that, in FIG. 8, the distance marked with L1 is greater than that indicated with L2.

Again with reference to the embodiment in FIGS. 8 and 9, the second body 52 is at least partially inserted into the first cylindrical seat 51*a* of the first body 51. Specifically, the second body 52 is rotatably connected to the first cylindrical seat 51*a* of the first body 51, preferably, by means of second bearings 9*b* that allow its rotation about the adjustment axis R.R with respect to the first body 51.

Preferably, the second bearings 9*b* are interposed between an inner surface 51A of the first cylindrical seat 51*a* of the first body 51 and an outer surface 52*b* of the second body 52. It should be noted that both the inner surface 51A of the first cylindrical seat 51*a* and the outer surface 52*b* of the second body 52 have a cylindrical geometry having a radial symmetry with respect to the adjustment axis R-R. That is, the adjustment axis R-R is both the axis of the inner surface 51A of the first cylindrical seat 51*a* and the outer surface 52*b* of the second body 52, in other words the inner surface 51A of the first cylindrical seat 51*a* and the outer surface 52*b* of the second body 52 are concentric.

The tool 4 is mounted on the second body 52 eccentrically with respect to the adjustment axis R-R.

In other words, the tool 4 is constrained to the second body 52 eccentrically with respect to the adjustment axis R-R, i.e. with respect to the axis about which the second body 52 rotates with respect to the first 51.

According to one aspect, the tool axis U-U is oriented parallel to the adjustment axis R-R. Specifically, with reference to FIG. 9, the tool axis U-U is separated from the adjustment axis R-R by a second distance e2 defining the eccentricity of the tool 4 with respect to the second body 52.

By way of example, the first distance e1 defining the eccentricity of the second body with respect to the first 52, 51 and the second distance defining the eccentricity of the tool 4 with respect to the second cover 52 are equal, i.e. they have the same value.

It should be noted that when the first body 51 is rotated by the actuation members 6 about the machining axis A-A, it drags the second body 52 which in turn drags the tool 4 in rotation about the machining axis A-A. The tool 4 will thus be able to carry out the aforementioned circumferential path C disclosed above and shown in FIGS. 10*b*, 10*c*, 11*a* and 11*b*.

In particular, it should be noted that by modifying the angular position of the second body 52 with respect to the first body 51, i.e. by rotating the second body 52 about the adjustment axis R-R, it is possible to vary the distance between the tool 4 and the machining axis A-A.

In this regard, FIGS. 10*a*, 10*b*, 10*c*, 11*a* and 11*b* show how the width of the diameter 2·R of the circumferential path C taken by the tool 4 varies with the variation of the angular position between the first and the second body 51, 52.

The relative angle α between the first and the second body 51, 52 in FIGS. 10*a*, 10*b*, 10*c*, 11*a* and 11*b* is respectively 0°, 45°, 90°, 135° and 180°.

Therefore, by modifying the relative angle between the first and the second body from 0° to 180°, it is possible to reduce the diameter 2·R of the circumferential path C taken by the tool 4 during actuation of the rotation of the first body 51 by means of the actuation members 6. Conversely, by modifying the relative angle between the first and the second body from 180° to 0° it is possible to increase the diameter 2·R of said circumferential path C.

Advantageously, during machining, by gradually varying the angular position of the second body 51 with respect to the first body 51 about the adjustment axis R-R, it is possible to evenly distribute the deformation action of the tool 4 on the workpiece in its different passes. This effect can be obtained, for example, by continuously varying the angular position of the second body with respect to the first 52, 51 while the latter rotates about the machining axis. In fact, by doing so, for the composition of the movements, the tool will make a spiral trajectory about the machining axis A-A exerting an almost constant thrust on the workpiece on each turn.

It is evident that the apparatus 1 that is the object of the present invention allows a gradual deformation of the workpiece P to be obtained on each pass. Therefore, by not concentrating most of the deformation in a single pass of the tool 4, its movement speed about the machining axis A-A can be increased without incurring the risk of damaging the machined surface, for example by forming corrugations thereon.

With particular reference to FIG. 11*a*, it can be noted that, if the first and second distances e1, e2 are equal, it is possible to match the tool axis U-U with the machining axis R-R by arranging the second body 52 at 180° with respect to the first body 51.

Preferably, the apparatus 1 comprises adjusting members 7 configured to rotate the second body 52 with respect to the first body 51 about the adjustment axis R-R so as to modify the distance of the tool 4 from the machining axis A-A in accordance with the above.

According to a possible embodiment, the adjusting members 7 comprise an electric motor adapted to control a ball screw 70 which is kinematically connected to the second body 52 for changing its angular position with respect to the first body 51.

Preferably, the tool 4 is rotatably connected in neutral to the second body 52 about tool axis U-U.

This advantageously allows the tool 4 to be used in machining as a roller. That is, it exerts a force on the workpiece P only with a radial direction with respect to the aforementioned axis of the piece P-P. Therefore, by doing so it is possible to make the force impressed by the tool 4 on the workpiece P in the circumferential direction negligible, thus preventing it from acting as a cutting tool. In this regard, it should be noted that beading machining is machining by plastic deformation and not by chip removal.

With reference to the embodiment of FIGS. 8 and 9, the second body 52 has a second cylindrical seat 52*a* having a second axis corresponding to the tool axis U-U.

The second cylindrical seat 52*a* is then arranged eccentrically with respect to the outer surface 52*b* of the second body 52. In this regard, it should be noted that the outer surface 52*b* of the second body 52 and the second cylindrical seat 52*a* have distinct axes, respectively the adjustment axis R-R and the tool axis U-U, which are spaced apart by the second distance e2 according to what is shown in FIG. 9.

The eccentricity of the second cylindrical seat 52*a* can be seen in FIG. 9 from the fact that the distance between the outer wall 52*b* of the second body 52 and the second cylindrical seat 52*a* has different values when calculated at opposite portions of the second body 52. In this regard, it should be noted that, in FIG. 9, the distance marked with L3 is greater than that indicated with L4.

The tool 4 is at least partially inserted into the second cylindrical seat 52*a* of the second body 52. Specifically, preferably, the tool is rotatably connected in neutral to the second cylindrical seat 52*a* of the second body 52, preferably by means of third bearings 9*c* that free the rotation of the tool 4 about the tool axis U-U with respect to the second body 52.

Preferably, the third bearings 9*c* are interposed between the inner surface 52A of the second cylindrical seat 52*a* of the second body 52 and a gripping portion 40 of the tool 4.

The second body 52 comprises locking members adapted to retain the tool 4, along the direction identified by the tool axis U-U, within the second cylindrical seat 52*a* to prevent it from inadvertently escaping during machining.

According to one aspect, the apparatus 1 comprises movement members 8 configured to move the processing unit 3 from and toward the support unit 2 to switch between a rest position in which the tool is spaced apart from the workpiece P, and an operating position in which the tool 4 is close to the workpiece P.

It should be specified that "close to the workpiece" means that the tool 4 is in contact with the workpiece P or that it is arranged in such a way as to come into contact with the workpiece P if moved away from or towards the machining axis A-A.

Figure 6:
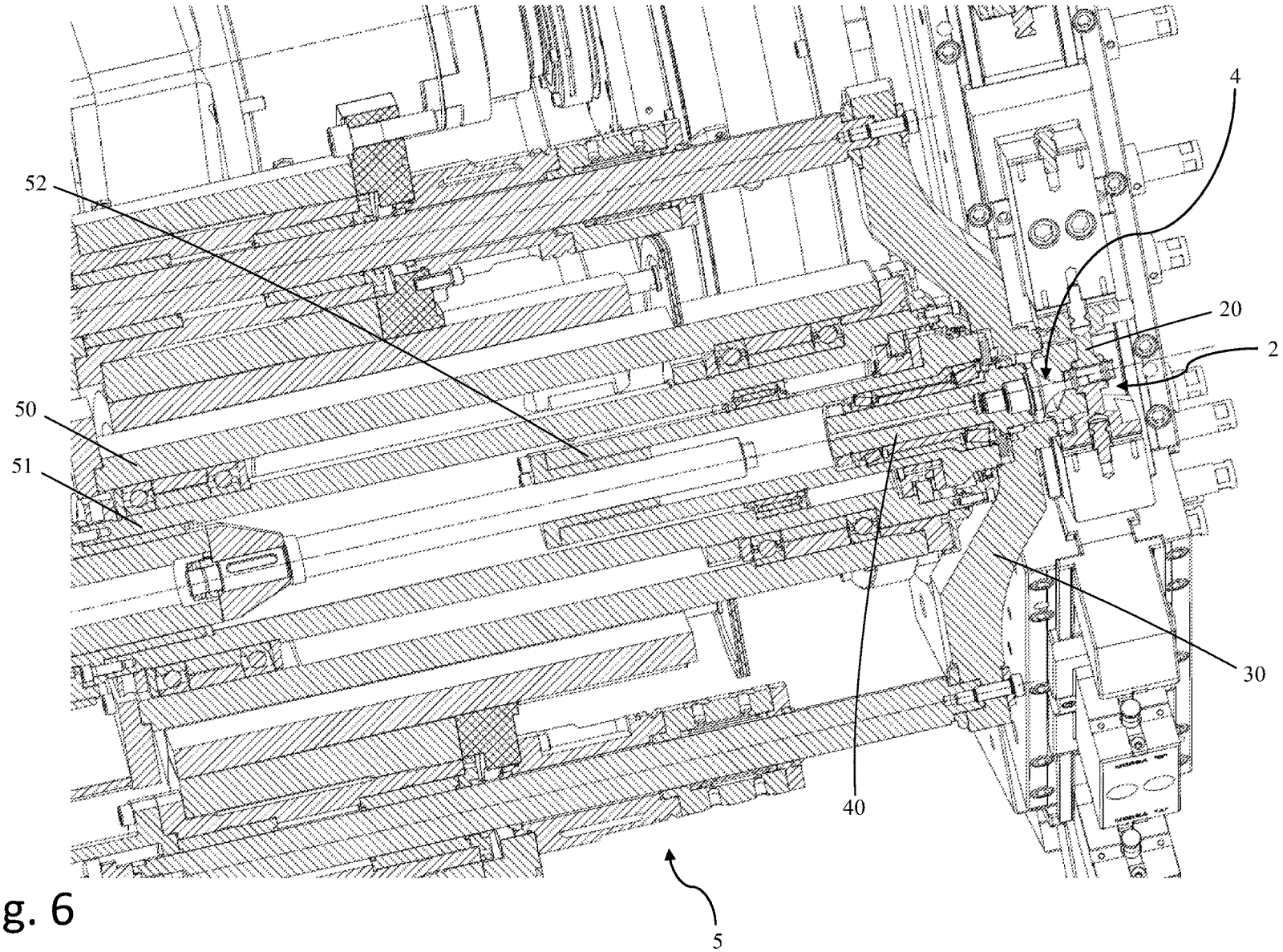
FIG. 6 shows a magnification of FIG. 5 to better highlight some technical details.

The rest position and the operating position are shown in FIGS. 3 and 6, respectively.

Preferably, the movement members 8 are hydraulically actuated.

According to one aspect, the support unit 2 comprises a mould 20 adapted to come at least partially into contact with the workpiece P during processing, and the processing unit 3 comprises a counter-mould 30 configured to act on the mould 20.

In detail the counter-mould 30 is movable from and toward the mould 20 of the support unit 2 for switching between an assembled position in which they are coupled and a disassembled position in which they are spaced apart. The disassembled and assembled position are shown in FIGS. 2 and 3, respectively.

It should be specified that during machining, the mould and the counter-mould 20, 30 are in the assembled position.

The object of the present invention is also a transfer machine 100 comprising the apparatus 1 as disclosed above.

In this regard, it should be specified that, in the context of the present invention, a transfer machine is a machine tool configured to combine, in a single production unit, the functions of a series of separate machine tools.

Figure 1:
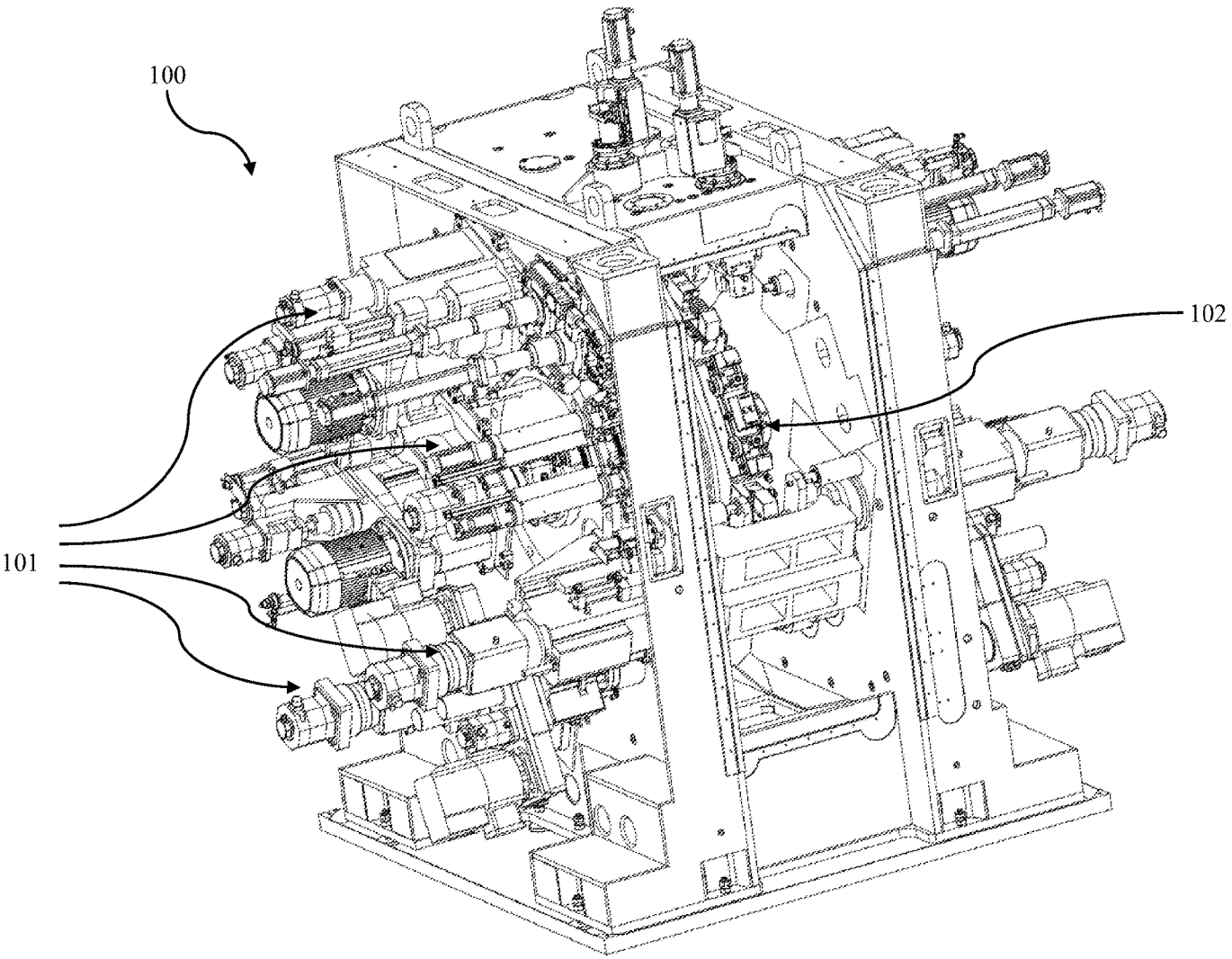
FIG. 1 shows a perspective view of a transfer machine comprising the apparatus for mechanical beading machining according to the present invention.

With reference to FIG. 1, the machine tool 100 comprises a plurality of machining stations 101 configured to perform mechanical machining on a plurality of workpieces P. Each piece, passing through the machining stations 101 sequentially, performs a specific production cycle that transforms it into a finished product or a semi-finished product.

At least one of the working stations 101 comprises the processing unit 3 disclosed above in relation to the apparatus 1. Thus, at least one of the working stations 101 is configured to perform mechanical beading machining.

The machine tool 100 also comprises also a support table 102 comprising a plurality of support regions 102*a* sequentially associable to the working stations 101 and configured to support the workpieces P.

At least one support region 102*a* comprises the support unit 2 disclosed above in relation to the apparatus 1.

Preferably, the support table 102 is configured to rotate about an axis of rotation M-M to sequentially associate the support regions 102*a* to the working stations 101.

It should be specified that the machine tool 100 therefore comprises special members for moving the table (not shown in the attached figures) adapted to rotate it about the axis of rotation M-M.

In a preferred embodiment, the machining axis A-A is oriented parallel to the axis of rotation M-M of the support table 102 according to what is shown in FIG. 3.

The invention claimed is:

1. An apparatus for mechanical beading machining, comprising:

a support unit configured to support a workpiece; and a processing unit facing the support unit and comprising:

a tool configured to plastically deform the workpiece and perform a mechanical beading machining;

a spindle configured to support and rotate the tool about a machining axis;

actuation members associated to the spindle and adapted to actuate the rotation of the tool about the machining axis;

wherein the spindle comprises:

a first body configured to be driven in rotation by the actuation members about the machining axis;

a second body mounted on the first body eccentrically with respect to the machining axis, the second body being rotatably connected to the first body about an adjustment axis distinct from the machining axis, the tool being mounted on the second body eccentrically with respect to the adjustment axis, wherein the machining axis is parallel to the adjustment axis, the machining axis being separated from the adjustment axis by a first distance defining the eccentricity of the second body with respect to the first body;

wherein the tool has a tool axis parallel to the adjustment axis, the tool axis being separated from the adjustment axis by a second distance defining the eccentricity of the tool with respect to the second body; and wherein the first distance and the second distance are equal.

2. Apparatus for mechanical beading machining according to claim 1, wherein:

the tool has a tool axis parallel to the adjustment axis;

the tool axis is separated from the adjustment axis by a second distance defining the eccentricity of the tool with respect to the second body.

3. Apparatus for mechanical beading machining according to claim 1, wherein:

the first body comprises a first cylindrical seat having a first axis, said first axis corresponding to the adjustment axis;

the second body is at least partially inserted in the first cylindrical seat of the first body.

4. Apparatus for mechanical beading machining according to claim 2, wherein the tool is rotatably connected in neutral to the second body about the tool axis.

5. Apparatus for mechanical beading machining according to claim 4, wherein:

the second body comprises a second cylindrical seat having a second axis, said second axis corresponding to the tool axis;

the tool is at least partially inserted into the second cylindrical seat of the second body.

6. Apparatus for mechanical beading machining according to claim 1 comprising adjusting members configured to rotate the second body with respect to the first body about the adjusting axis so as to adjust the distance of the tool from the machining axis.

7. Apparatus for mechanical beading machining according to claim 1 comprising movement members configured to move the processing unit from and toward the support unit to switch between a rest position in which the tool is spaced apart from the workpiece, and an operating position in which the tool is close to the workpiece.

8. Apparatus for mechanical beading machining according to claim 1, wherein:

the support unit comprises a mould adapted to accommodate the workpiece;

the processing unit comprises a counter-mould movable from and toward the mould of the support unit for switching between an assembled position in which the mould and the counter-mould are coupled and a disassembled position in which the mould and the counter-mould are spaced apart.

9. Transfer machine comprising:

a plurality of working stations configured to perform mechanical processing on a plurality of workpieces;

a support table comprising a plurality of support regions sequentially associable to the working stations and configured to support the workpieces;

at least one apparatus for mechanical beading machining comprising:

a support unit configured to support a workpiece;

a processing unit facing the support unit and comprising:

a tool configured to plastically deform the workpiece and perform a mechanical beading machining;

a spindle configured to support and rotate the tool about a machining axis;

actuation members associated to the spindle and adapted to actuate the rotation of the tool about the machining axis;

wherein the spindle comprises:

a first body configured to be driven in rotation by the actuation members about the machining axis;

a second body mounted on the first body eccentrically with respect to the machining axis, the second body being rotatably connected to the first body about an adjustment axis distinct from the machining axis, the tool being mounted on the second body eccentrically with respect to the adjustment axis;

wherein the machining axis is parallel to the adjustment axis, the machining axis being separated from the adjustment axis by a first distance defining the eccentricity of the second body with respect to the first body;

wherein the tool has a tool axis parallel to the adjustment axis, the tool axis being separated from the adjustment axis by a second distance defining the eccentricity of the tool with respect to the second body;

wherein the first distance and the second distance are equal wherein at least one working station comprises the processing unit of the apparatus for mechanical beading machining; and wherein at least one support region comprises the support unit of the apparatus for mechanical beading machining.

10. Transfer machine according to claim 9, wherein:

the support table is configured to rotate about an axis of rotation to sequentially associate the support regions to the working stations;

the machining axis is arranged parallel to the axis of rotation of the support table.

* * * * *